United States Patent [19]

Haeussler

[11] 4,183,186

[45] Jan. 15, 1980

[54] MULTILAYER STEEL-REINFORCED CONCRETE PANELS

[76] Inventor: Ernst Haeussler, Grashofstrasse 47, Essen-Bredeney, Fed. Rep. of Germany

[21] Appl. No.: 935,917

[22] Filed: Aug. 23, 1978

[30] Foreign Application Priority Data

Aug. 24, 1977 [DE] Fed. Rep. of Germany ..... 2738098

[51] Int. Cl.[2] ..... E04B 2/00; E04B 5/00; E04B 5/04; E04C 2/04

[52] U.S. Cl. ..... 52/410; 52/405; 52/612; 428/223

[58] Field of Search ..... 428/223; 52/309.12, 52/309.14, 309.17, 405, 410, 650, 686, 687, 612

[56] References Cited

U.S. PATENT DOCUMENTS

| | | | |
|---|---|---|---|
| 3,476,912 | 11/1969 | Garrison | 52/410 X |
| 3,494,088 | 2/1970 | Körner | 52/650 X |
| 3,750,355 | 8/1973 | Blum | 52/309.12 |
| 3,879,908 | 4/1975 | Weismann | 52/309.12 X |
| 3,996,713 | 12/1976 | Haeussler | 52/410 X |
| 4,117,639 | 10/1978 | Steenson | 52/410 X |

*Primary Examiner*—George F. Lesmes
*Assistant Examiner*—Daniel R. Zirker
*Attorney, Agent, or Firm*—Karl F. Ross

[57] ABSTRACT

A multilayer steel-reinforced concrete panel assembly comprises a steel-reinforced concrete outer plate, a steel-reinforced concrete inner plate and a layer of insulation sandwiched between these plates. The outer plate and the inner plate are interconnected by flat anchors traversing the intermediate insulation layer and the anchors are distributed along an imaginary circle whose diameter is greater than the length of the small side of the rectangular panels. At least three such flat anchors are provided, two of which are capable of absorbing all of the stresses while all of the flat anchors are disposed symmetrically with respect to the longitudinal plan axis of the panel. The flat anchors take up all of the stresses to which the panel may be subject and thus eliminate the need for an additional anchor at the centroid of the panel, i.e. the center of stress forces and the like.

5 Claims, 5 Drawing Figures

MULTILAYER STEEL-REINFORCED CONCRETE PANELS

FIELD OF THE INVENTION

My present invention relates to a multilayer steel-reinforced concrete panel and, more particularly, to a so-called sandwich panel of the type used for the fabrication of structural facades.

BACKGROUND OF THE INVENTION

It has been proposed heretofore (see U.S. Pat. No. 3,996,713 and the German Patent Document No. 2 514 300) to provide so-called sandwich panels or, more specifically, prefabricated multilayer steel-reinforced concrete panels with a steel-reinforced concrete outer plate, a steel-reinforced concrete inner plate, and an intermediate layer of thermal and acoustic insulating material between these plates. The plates are held together by anchors which traverse the insulating layer and are locked to the respective plates.

As will be apparent from the prior art as represented by the aforementioned patent and patent document, the anchors interconnecting the concrete plates include so-called flat anchors or membrane anchors which can comprise steel sheets or plates perpendicular to the concrete plates and affording a limited degree of relative mobility of the concrete plates.

These flat anchors are uniformly distributed along an imaginary circle whose diameter is larger than the length of the small size of the rectangular panel.

The flat anchors are membrane anchors as there described, with a generally flat configuration and are usually composed of sheet steel although it is conceivable to form the flat anchors as an assembly of rods provided that the assembly is deflectable transverse to its plane. Flat anchors are thus elastically deformable and constitute membrane connections at spaced-apart locations along this circle between the two reinforced-concrete plates. The portions of the flat anchors embedded in the reinforced-concrete plates are statically connected to the reinforcing steel, e.g. mats, of the reinforced concrete plates.

However, in spite of the unique advantages of sandwich panels of the aforedescribed type and the sandwich panel constructions of the prior art mentioned in said U.S. patent, it has been found to be necessary in practice to provide an additional anchor at the centrum of the panel. At this centrum, the anchor is generally rigid and can consist of an anchor sleeve with connecting pins or rods embedded in the two concrete plates. A system which also uses a rigid anchor at the centrum is described in U.S. Pat. No. 3,757,482 and German Patent Document No. 20 08 402. In the latter system hairpin-like anchors are provided.

The flat anchors can be traversed by rods which are embedded in the reinforced concrete of the two plates and may be welded, if desired, to the reinforcing mats thereof.

The provision of a rigid anchor at the centrum of the panel has been found to be expensive and undesirable from a static viewpoint since this anchor must not only be capable of withstanding the resultant forces of this centrum, but must accommodate the thermal expansion, and shrinkage effects which invariably arise. The presence of a rigid anchor at the centrum interferes and may result, in turn, in undue stress upon the concrete plates.

Furthermore, it has been recognized that it is of advantage to allow for relative shifting of the two plates parallel to themselves to a limited degree and even this has been unduly restricted by the additional rigid member at the anchoring centrum.

OBJECTS OF THE INVENTION

It is the principal object of the present invention to provide a multilayer steel-reinforced concrete panel which avoids the disadvantages of the earlier systems described above but retains the advantages thereof and is less expensive and more capable of accommodating stresses, thermal expansion and contraction phenomena, and shrinkage than the earlier systems.

Still another object is to provide an improved prefabricated multilayer sandwich panel for the purposes described.

SUMMARY OF THE INVENTION

These objects and others which will become apparent hereinafter are attained, in accordance with the present invention, in a multilayer panel which comprises an outer steel-reinforced concrete plate, an inner steel-reinforced concrete plate spaced from the outer plate, and an intermediate insulating layer between these plates, the plates being anchored to one another by anchoring means traversing the insulating layer. The anchoring means, according to the invention, consists exclusively of so-called flat or membrane anchors of the aforedescribed type spaced from the centrum of the panel, at least three such flat anchors being disposed along an imaginary circle whose diameter is greater than the length of the small side of the panel and hence greater than the small side of each of the rectangular plates making up the panel. According to an essential feature of the invention, the flat anchors are so constructed and arranged that two of them (i.e. of the three or more disposed along this circle) are capable of taking up all of the stresses to which the plates may be subject relative to one another, while all of the flat anchors are disposed symmetrically with respect to the longitudinal plan axis of the rectangular panel.

The invention is based upon the discovery that the two concrete plates can be adequately held together and yet allow the requisite degree of thermal expansion and contraction and shrinkage of one plate relative to the other about a connection centrum without a rigid anchor at this centrum as long as three or more membrane-type anchors are disposed symmetrically along the aforementioned circle and at least two of these flat anchors are capable of taking up all of the relative force which develops between the two plates and, further, all of the flat anchors are oriented symmetrically with respect to the aforedescribed axis. Thus, a definition of the anchor means as consisting of flat anchors completely excludes a rigid anchor at the center of the circle or at the connection centrum.

All of the stresses which develop between the two plates are taken up by the flat anchors regardless of the direction in which these forces are effective, regardless of the orientation of the panel in its ultimate structure and regardless of the purpose served by the panel.

The anchor system has, surprisingly, been found to be effective to prevent buckling or bulging of the inner plate or outer plate as a result of differences in thermal expansion or contraction and differences in shrinkage without the development of any excessive stresses.

The flat anchors and the rods whereby these are retained in the reinforced concrete plates and whereby these flat anchors can be connected to the reinforcing mats layed into these plates, can be of simple construction. This is especially the case when the flat anchors are uniformly distributed about the centrum of the panel along the imaginary circle mentioned above, the stresses which develop cancelling each other because of the symmetry.

When especially heavy panels are to be provided or the panels are expected to be subject to significant thermal expansion or contraction or a high degree of shrinkage is to be encountered, it has been found to be advantageous to constitute the anchoring means with additional flat anchors which are uniformly distributed (angularly equispaced) around a smaller circle whose diameter may be less than the length of the small side of the panel. This smaller circle can be concentric with the larger circle and can lie fully within the plan or outline of the panel.

Each of the flat anchors, according to the invention, can be composed of sheet steel and can be planar so as to be, as a rule, tangential to the respective circle. However, it has been found to be advantageous in most cases to impart a slight curvature to the flat anchors, preferably with a radius of curvature corresponding to the radius of the circle. In this case, each flat anchor lies along an arc segment of the respective circle.

It has been found to be advantageous, although not necessary, to provide foils allowing relative slippage between the plates and the intermediate layer or between several sublayers of the intermediate layers. Such foils facilitate relative mobility of the members between which they are provided in the plane of the panel.

It has been found that the construction of the present invention is relatively simple and inexpensive and attains the objects set forth above so as to improve upon the prior-art construction. The flat anchors can be simple sheet steel plates which may be perforated to accommodate the anchoring rods (see U.S. Pat. No. 3,996,713) although they can also be sections which are cut from reinforcing-steel mats or even truss structures of rods specially provided.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
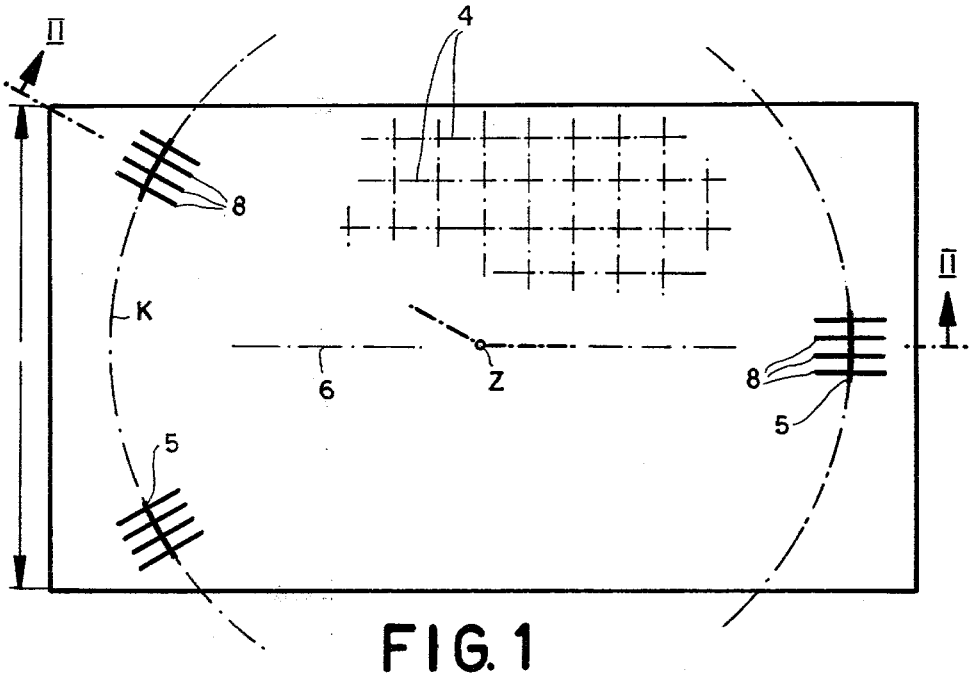
FIG. 1 is a plan view of a steel-reinforced concrete plate adapted to be included in a panel according to the invention.
Figure 2:
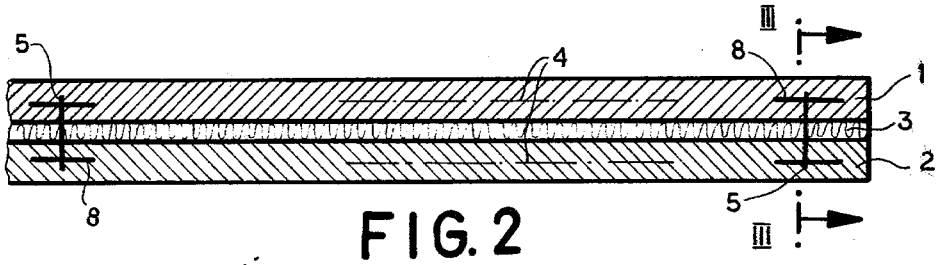
FIG. 2 is a cross-sectional view taken along the line II—II of FIG. 1 through a panel using the concrete plate of FIG. 1.
Figure 3:
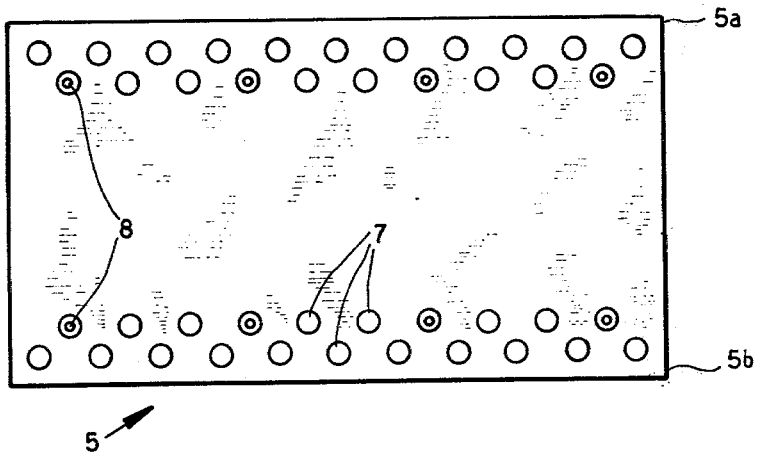
FIG. 3 is a cross-sectional view taken along the line III—III of FIG. 2.

As can be seen from FIGS. 1–3, the multilayer panel comprises a steel-reinforced concrete outer plate 1, a steel-reinforced concrete inner plate 2 and an intermediate layer 3 of thermal insulation between these plates. The panel has a rectangular cross-section with a small side of a length L.

The concrete outer plate 1 and the concrete inner plate 2 each contain reinforcement in the form of orthogonal arrays of rods 4 which can define a concrete reinforcing mat as shown in dot-dash lines in FIGS. 1 and 2 fragmentarily. The insulating intermediate layer 3 can be composed of a foamed synthetic resin.

The plates are held together exclusively by flat anchors 5 which traverse the intermediate layer 3 and have their opposite edges 5*a* and 5*b* anchored in the two plates 1 and 2, respectively. The flat anchors are uniformly distributed over the plan of the panel 1, 2, 3 along an imaginary circle K whose diameter is greater than L. This circle has been shown in FIGS. 1 and 5. Another group of flat anchors 5' are uniformly distributed about an inner circle K' whose diameter is less than L.

The flat anchors 5 are so constituted that two anchors of the circle K suffice to take up all of the stresses developed between the two plates 1 and 2 as can be determined easily by experiment or conventional static methods.

Nevertheless, three or more such anchors are provided about the circle K in the embodiment of FIG. 1 and about each circle K and K' in the embodiment of FIG. 2 so that all of the anchors are symmetrical with respect to the longitudinal axis 6 of the plan of the rectangular panel 1, 2, 3. The axis 6 is thus a line parallel to but midway between the longitudinal edges of the panel in the median plane between the plates 1 and 2. A central rigid anchor is omitted and no anchor is provided at the centrum Z of the panel. This centrum, of course, coincides with the center of the circle K in FIG. 1 and the circles K and K' of FIG. 5.

Figure 4:
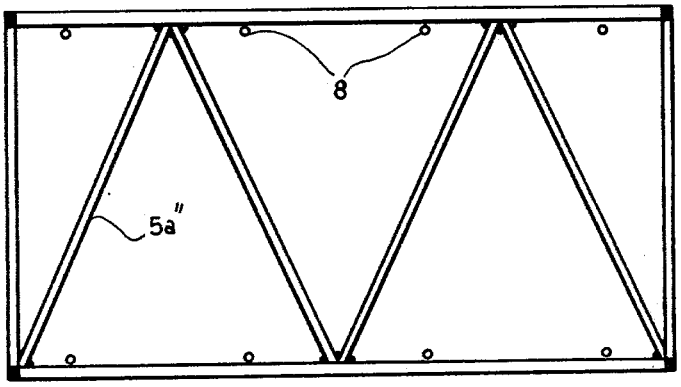
FIG. 4 is a view similar to that of FIG. 3 of a flat anchor in accordance with another embodiment of the invention.

From FIGS. 1–3 it will also be apparent that the anchors 5 comprise planar plates formed with openings 7 through which rods 8 can be passed to secure the anchors 5 to the reinforcing mats 4 (see also U.S. Pat. No. 3,996,713). However, as FIG. 4 shows, these anchors may also be planar trusses 5'' formed from rods 5*a''* which are welded together and which can be welded to or can simply receive the rods 8.

Figure 5:
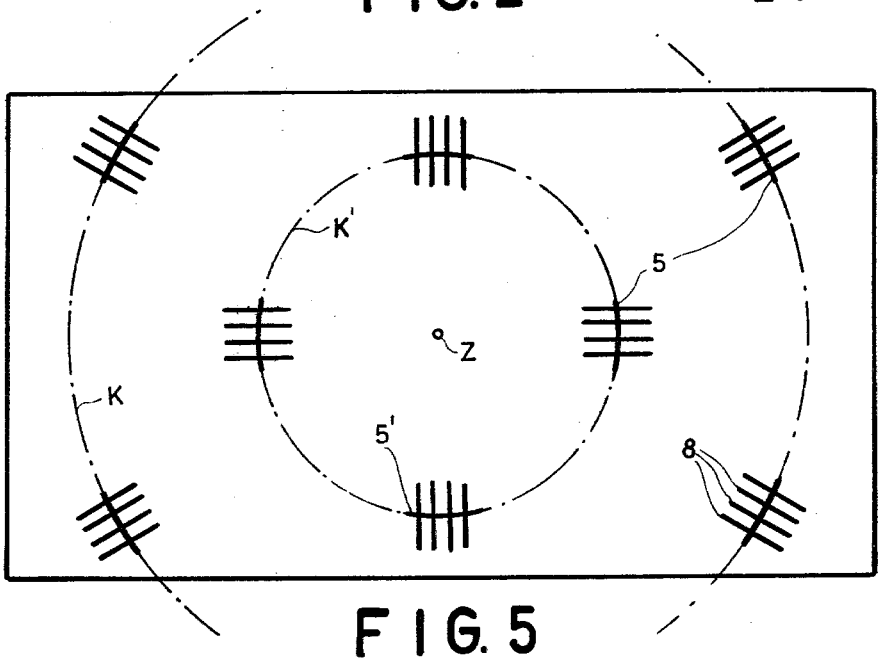
FIG. 5 is a view similar to FIG. 1 illustrating still another plate for a multilayer panel according to the invention.

In the embodiment of FIG. 5, the flat anchors are slightly bent to conform to the curvature of the respective circles.

I claim:

1. A rectangular multilayer panel comprising:

a rectangular steel-reinforced concrete outer plate;

a rectangular steel-reinforced concrete inner plate spaced from but juxtaposed and coextensive with the outer plate;

a layer of insulation coextensive with and between said plates; and anchor means interconnecting said plates, said anchor means consisting of at least three flat anchors of rectangular configuration, each of said flat anchors being embedded in both of said plates and traversing said layer perpendicular to the planes thereof, two of said flat anchors taking up all of the stresses between said plates and all of said anchors being disposed symmetrically with respect to an axis through the force and stress centrum of the panel parallel to the long sides thereof, said anchors being disposed about an imaginary circle having a diameter greater than the length of the short side of the panel and having a center at said centrum of the panel, the centrum of the panel being free from any anchor interconnecting said plates.

2. The panel defined in claim 1 wherein said anchors are distributed uniformly around said circle.

3. The panel defined in claim 2, further comprising a plurality of additional flat anchors bridging said plates and traversing said layer and angularly equispaced about a smaller circle concentric with the first-mentioned circle and wholly within the outline of the panel.

4. The panel defined in claim 1 wherein said flat anchors are planar and lie tangential to said circle.

5. The panel defined in claim 1 wherein said flat anchors are bent to conform to the curvature of said circle.

* * * * *